US008770505B2

(12) United States Patent
Shinozaki

(10) Patent No.: US 8,770,505 B2
(45) Date of Patent: Jul. 8, 2014

(54) WIRE MATERIAL ACCUMULATOR

(75) Inventor: Kiyohiko Shinozaki, Yokkaichi (JP)

(73) Assignee: Sumitomo Wiring Systems, Ltd., Mie (JP)

( * ) Notice: Subject to any disclaimer, the term of this patent is extended or adjusted under 35 U.S.C. 154(b) by 502 days.

(21) Appl. No.: 13/263,651

(22) PCT Filed: Mar. 29, 2011

(86) PCT No.: PCT/JP2011/057733

§ 371 (c)(1),
(2), (4) Date: Oct. 7, 2011

(87) PCT Pub. No.: WO2012/046468

PCT Pub. Date: Apr. 12, 2012

(65) Prior Publication Data

US 2012/0256034 A1 Oct. 11, 2012

(30) Foreign Application Priority Data

Oct. 7, 2010 (JP) ..... 2010-227298

(51) Int. Cl.
*B65H 51/20* (2006.01)

(52) U.S. Cl.
USPC ..... 242/364.2; 226/118.2

(58) Field of Classification Search
USPC ..... 242/364.11, 364.2, 552; 226/118.1, 226/118.2, 118.3
See application file for complete search history.

(56) References Cited

FOREIGN PATENT DOCUMENTS

| | | |
|---|---|---|
| JP | A-57-126349 | 8/1982 |
| JP | A-61-045866 | 3/1986 |
| JP | U-64-47740 | 3/1989 |
| JP | A-2000-327219 | 11/2000 |

OTHER PUBLICATIONS

Jun. 7, 2011 International Search Report issued in International Patent Application No. PCT/JP2011/057733.

*Primary Examiner* — William E Dondero
(74) *Attorney, Agent, or Firm* — Oliff PLC

(57) ABSTRACT

A wire material accumulator is configured to accumulate a wire material. The wire material accumulator includes a plurality of fixed-side pulleys rotatably supported on a fixed axis part, and a plurality of movable-side pulleys rotatably supported on a movable axis part that is supported so as to be movable toward and away from the fixed axis part. The wire material accumulator further includes a drawing mechanism part that applies a drawing force to a wire material W in the middle of the wire material being wrapped from any one to another of the plurality of fixed-side pulleys and the plurality of movable-side pulleys.

8 Claims, 5 Drawing Sheets

WIRE MATERIAL ACCUMULATOR

TECHNICAL FIELD

The present invention relates to a technique of accumulating a wire material such as an electric wire or an electric wire core.

BACKGROUND ART

In a manufacturing step, a processing step, or the like, of an electric wire, a wire accumulator is adopted as an apparatus for constantly and continuously supplying a wire material such as an electric wire or an electric wire core.

For example, an electric wire is manufactured through the steps in a wire material supply part that supplies a wire material wound on a bobbin or the like, then a manufacturing process part that applies a process such as a resin coating to the wire material continuously supplied from the wire material supply part, and then a winding part that winds the wire material on a bobbin or the like. A wire material accumulator is provided, for example, between the wire material supply part and the manufacturing process part, or between the manufacturing process part and the winding part. The wire material accumulator accumulates the wire material in a position between the wire material supply part and the manufacturing process part, and thereby, at a time of replacing the bobbin of the wire material supply part, supplies the accumulated wire material to the manufacturing process part, so that the wire material can be constantly and continuously supplied. At a time of replacing the bobbin of the winding part, the wire material accumulator similarly enables the wire material to be continuously supplied from the manufacturing process part, by the accumulation of the wire material supplied from the manufacturing process part.

Examples of the above-mentioned accumulator include one disclosed in Patent Document 1.

An accumulator disclosed in the Patent Document 1 includes a movable ring and a fixed ring. The movable ring has a thrust force in a direction away from the fixed ring. A wire material is wrapped around the movable ring and the fixed ring so as to stretch therebetween. When a distance between axes of the fixed ring and the movable ring is increased, the wire material is accumulated, while when the distance between the axes of the fixed ring and the movable ring is reduced, the accumulated wire material is supplied.

PRIOR-ART DOCUMENTS

Patent Documents

Patent Document 1: Japanese Patent Application Laid-Open No. 1986-45866

SUMMARY OF THE INVENTION

Problems to be Solved by the Invention

However, in the accumulator disclosed in the Patent Document 1, acceleration of the speed of drawing the wire material causes a resistance force resulting from, for example, inertial forces of the fixed ring and the movable ring to be applied to the wire material at portions where the wire material is placed around the fixed ring and the movable ring.

As a result, a high tensile force acts on the wire material at a portion where the wire material is unwound from the accumulator. This causes a problem that, for example, the wire material is stretched. On the other hand, at a portion where the wire material is introduced into the accumulator, only a small tensile force acts on the wire material. Consequently, the wire material is loosened, which may cause a problem that the wire material derails from the fixed ring, the movable ring, or the like. In addition, the wire material tends to be displaced because of, for example, the instability of the tensile force acting on the wire material in each part within the accumulator and the instability over time of the tensile force acting on the wire material. As a result, the displaced wire material may come into contact with a groove wall of the fixed ring or the movable ring, a peripheral member, or the like, so that the wire material may be damaged.

Therefore, an object of the present invention is to stabilize a tensile force applied to a wire material within an accumulator.

Means for Solving the Problems

To solve the above problems, a first aspect is a wire material accumulator configured to accumulate a wire material, the wire material accumulator including: a plurality of fixed-side pulleys rotatably supported on a fixed axis part; a plurality of movable-side pulleys rotatably supported on a movable axis part that is supported so as to be movable toward and away from the fixed axis part; and a drawing mechanism part that applies a drawing force to a wire material in the middle of the wire material being wrapped from any one to another of the plurality of fixed-side pulleys and the plurality of movable-side pulleys.

A second aspect is the wire material accumulator according to the first aspect, wherein the drawing mechanism part includes a drawing pulley around which the wire material can be wrapped and a rotary drive part that drives the drawing pulley in rotation, the drawing pulley being arranged in such a position that the wire material can be wrapped around the drawing pulley in the middle of being wrapped from any one to another of the plurality of fixed-side pulleys and the plurality of movable-side pulleys.

A third aspect is the wire material accumulator according to the second aspect, wherein the drawing pulley is provided at the side opposite to the movable-side pulleys across the fixed-side pulleys.

A fourth aspect is the wire material accumulator according to the third aspect, wherein the diameter of the drawing pulley is larger than the diameter of the fixed-side pulley.

A fifth aspect is the wire material accumulator according to any one of the second to fourth aspects, wherein the drawing pulley is provided in such a position that one extension portion of the wire material wrapped around the drawing pulley can be guided by any of the plurality of fixed-side pulleys and wrapped around any of the plurality of movable-side pulleys while the other extension portion of the wire material wrapped around the drawing pulley can be wrapped around any of the plurality of movable-side pulleys without a contact with the plurality of fixed-side pulleys.

A sixth aspect is the wire material accumulator according to any one of the first to fifth aspects, wherein the drawing mechanism part comprises a plurality of drawing mechanism parts.

A seventh aspect is the wire material accumulator according to the sixth aspect, wherein the plurality of drawing mechanism parts are provided so as to be shifted from one another in a direction of movement of the movable axis part.

An eighth aspect is the wire material accumulator according to the sixth aspect, wherein the plurality of drawing mechanism parts are provided so as to be shifted from one another in a direction crossing both an axis of the fixed axis part and a direction of movement of the movable axis part.

Effects of the Invention

The wire material accumulator according to the first aspect includes the drawing mechanism part that applies a drawing force to the wire material in the middle of the wire material being wrapped from any one to another of the plurality of fixed-side pulleys and the plurality of movable-side pulleys. Therefore, in a case of accelerating an external drawing speed of the wire material, a tensile force applied to the wire material can be suppressed at a portion of the wire material being unwound from the accumulator, while a tensile force applied to the wire material can be increased at a portion of the wire material being introduced into the accumulator. Thus, within the accumulator, a tensile force applied to the wire material can be stabilized.

In the second aspect, the wire material is wrapped around the drawing pulley in the middle of being wrapped, and thereby a tensile force can be applied to the wire material.

In the wire material accumulator according to the third aspect, the drawing pulley is provided at the side opposite to the movable-side pulleys across the fixed-side pulleys. Therefore, the wire material accumulator can be installed in an elongated space. Additionally, the length of the wire material stretched between the drawing pulley and the fixed-side pulleys or the movable-side pulleys can be relatively shortened. This makes an operation for wrapping and stretching the wire material easy, and moreover can suppress displacement of the wire material during the operation of the accumulator.

In the fourth aspect, the diameter of the drawing pulley is larger than the diameter of the fixed-side pulleys. This allows the wire material wrapped around the drawing pulley to be easily wrapped around the movable-side pulleys while suppressing a contact with the fixed-side pulleys.

In the fifth aspect, damage to the wire material which may be caused by a contact between the wire material and the fixed-side pulleys can be suppressed with a relatively compact configuration.

In the sixth aspect, a tensile force applied to the wire material can be furthermore stabilized.

In the seventh aspect, a plurality of drawing mechanism parts can be provided while suppressing interference among the plurality of drawing mechanism parts.

In the eighth aspect, a plurality of drawing mechanism parts can be provided while suppressing interference among the plurality of drawing mechanism parts.

EMBODIMENT FOR CARRYING OUT THE INVENTION

Figure 1:
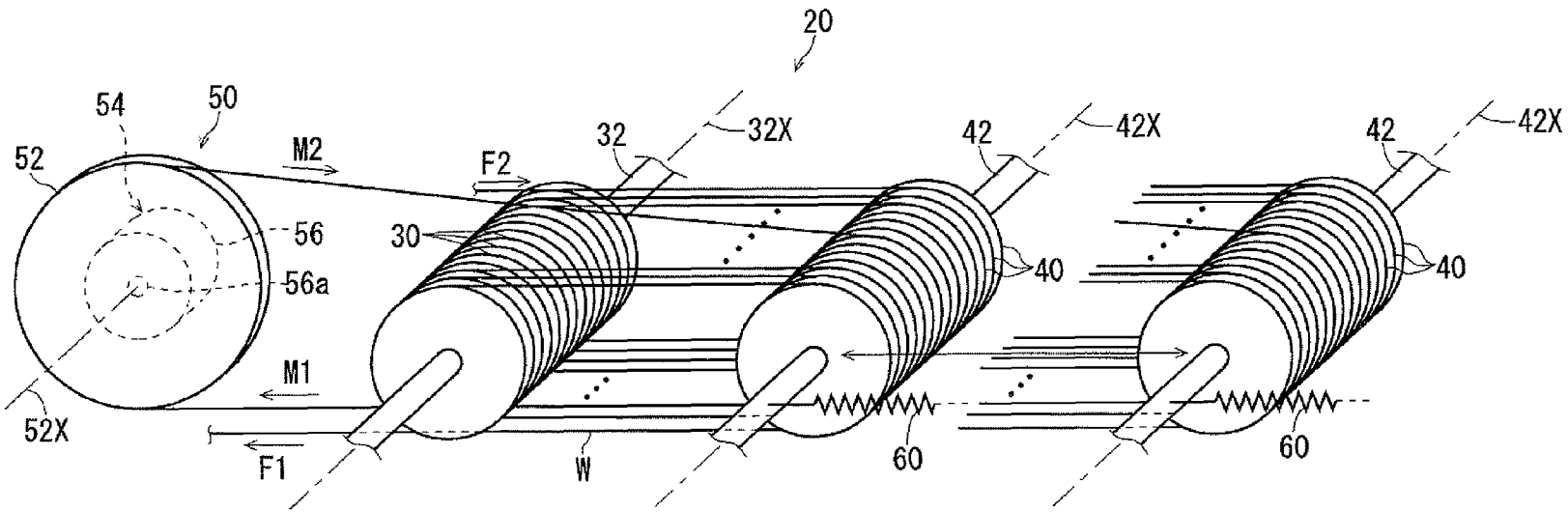
FIG. 1 is a schematic perspective view showing a wire material accumulator according to an embodiment.
Figure 2:
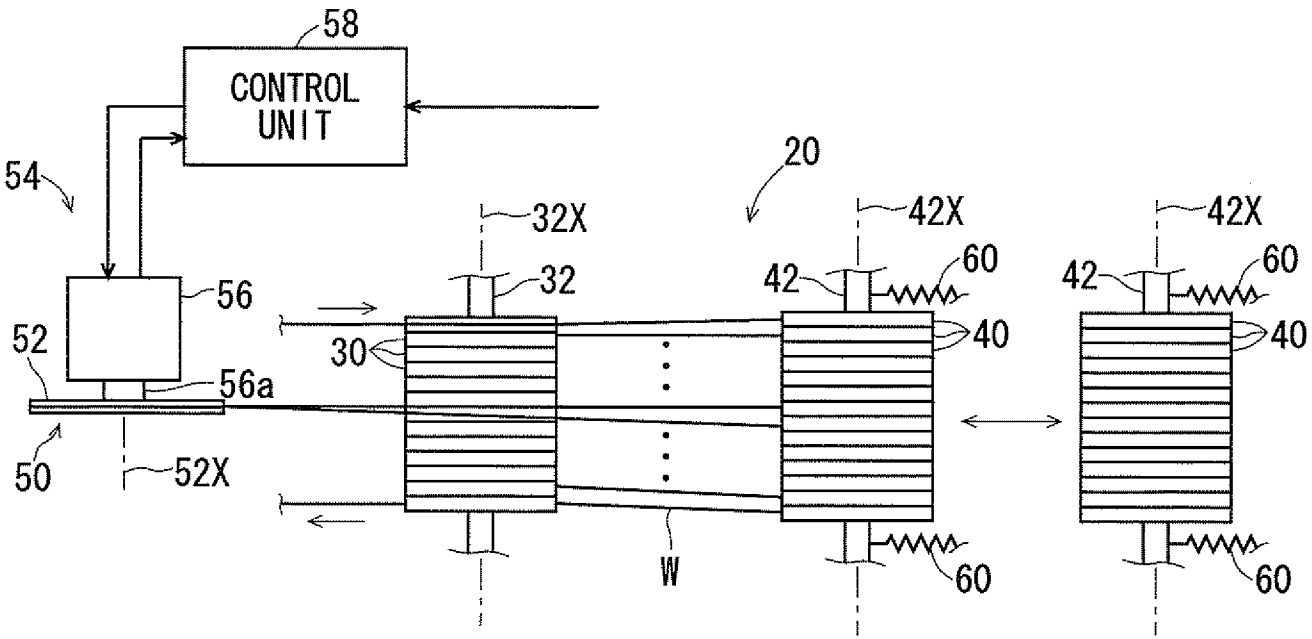
FIG. 2 is a schematic side view showing the wire material accumulator.
Figure 3:
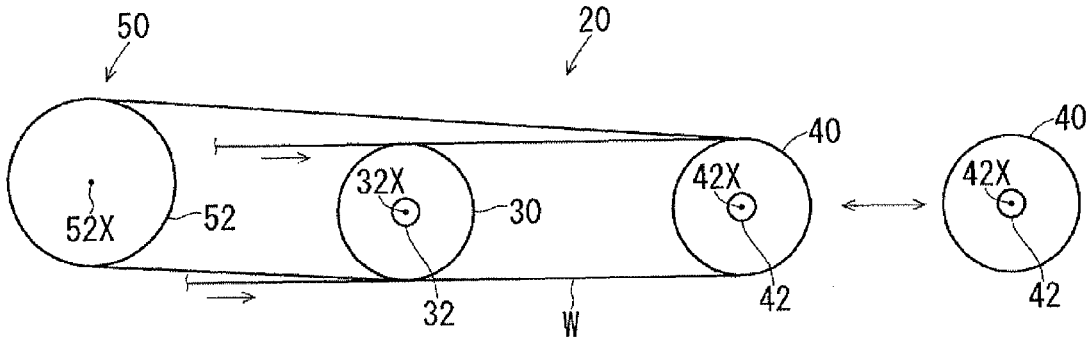
FIG. 3 is a schematic side view showing the wire material accumulator.

Hereinafter, a wire material accumulator according to an embodiment will be described. FIG. 1 is a schematic perspective view showing a wire material accumulator 20. FIG. 2 is a schematic side view showing the wire material accumulator 20. FIG. 3 is a schematic side view showing the wire material accumulator 20. Here, an example in which the wire material accumulator 20 accumulates an electric wire core as a wire material W will be described. More specifically, a description will be given of an example in which the wire material accumulator 20 accumulates the core as the wire material W at the downstream of a wire material supply part that continuously supplies the core wound on and accommodated in a bobbin or the like, or at the downstream side of an extrusion coating device that applies, for example, an extrusion coating of a resin to the core continuously supplied. The wire material accumulator 20 itself may be used as an apparatus for accumulating, as the wire material W, not only the electric wire core but also various wire materials such as an electric wire.

The wire material accumulator 20 includes a plurality of fixed-side pulleys 30, a plurality of movable-side pulleys 40, and a drawing mechanism part 50. The wire material W is wrapped around the plurality of fixed-side pulleys 30 and the plurality of movable-side pulleys 40 so as to stretch therebetween, and thereby accumulated between the plurality of fixed-side pulleys 30 and the plurality of movable-side pulleys 40. In the middle of the wire material W being wrapped around the plurality of fixed-side pulleys 30 and the plurality of movable-side pulleys 40, the drawing mechanism part 50 applies a drawing force to the wire material W.

More specifically, the plurality of fixed-side pulleys 30 are rotatably supported on a fixed axis part 32. The fixed axis part 32 is configured as a rod-like member that is supported in a given position. The fixed axis part 32 may be rotatably supported, or alternatively may be non-rotatably supported. The fixed axis part 32 may be driven in rotation toward a direction of rotation of the fixed-side pulleys 30 (toward a direction of rotation of the wire material being fed) by a motor or the like. The fixed-side pulley 30 is disk-shaped, and has an annular groove formed on an outer circumference thereof so that the wire material W can be wrapped therealong. The plurality of fixed-side pulleys 30 are supported on the fixed axis part 32 while being adjacent to one another. Preferably, a gap is provided between ones of the fixed-side pulleys 30 in such a manner that the fixed-side pulleys 30 cannot interfere with one another. Each of the fixed-side pulleys 30 is rotatably supported on the fixed axis part 32 via a bearing such as a roller bearing or a fluid bearing. The fixed-side pulleys 30 can freely rotate independently of one another.

The plurality of movable-side pulleys 40 are rotatably supported on a movable axis part 42. The movable axis part 42 is configured as a rod-like member, and supported such that it can be moved toward and away from the fixed axis part 32. Examples of a mechanism for movably supporting the movable axis part 42 include various straight-line guide mechanisms such as a mechanism in which a pair of bearings provided at both end portions of the movable axis part 42 are movably supported by means of a pair of rails provided at both end portions of the movable axis part 42 so as to extend along a direction perpendicular to the fixed axis part 32. Needles to say, similarly to the fixed axis part 32, the movable axis part 42 may be rotatably supported, or alternatively may be non-rotatably supported. The movable axis part 42 may be driven in rotation toward a direction of rotation of the movable-side pulleys 40 (toward a direction of rotation of the wire material being fed) by a motor or the like.

The movable-side pulley 40 is disk-shaped, and has an annular groove formed on an outer circumference thereof so that the wire material W can be wrapped therealong. Here, the movable-side pulley 40 has the same diameter and the same shape as those of the fixed-side pulley 30. However, this is not necessary. The plurality of movable-side pulleys 40 are supported on the movable axis part 42 while being adjacent to one another. Preferably, a gap is provided between ones of the movable-side pulleys 40 in such a manner that the movable-side pulleys 40 cannot interfere with one another. A pitch (interval of wrapping of the wire material W) between ones of the plurality of movable-side pulleys 40 is preferably equal to a pitch between ones of the plurality of fixed-side pulleys 30. Each of the movable-side pulleys 40 is rotatably supported on the movable axis part 42 via a bearing such as a roller bearing or a fluid bearing. The movable-side pulleys 40 can freely rotate independently of one another.

A wire-accumulating-force application mechanism part 60 applies a force to the movable axis part 42 in a direction away from the fixed axis part 32. The wire-accumulating-force application mechanism part 60 is configured to apply a force traveling away from the fixed axis part 32 to the movable axis part 42 or to a bearing or the like that moves integrally with the movable axis part 42. Examples of the wire-accumulating-force application mechanism part 60 include a coil spring having one end thereof coupled to an end portion side of the movable axis part 42 and the other end thereof coupled to an outward fixed position along a direction of movement of the movable axis part 42, and a mechanism in which a weight and the movable axis part 42 are coupled to each other by a wire appropriately wrapped via a pulley or the like so that the movable axis part 42 is pulled by means of the gravity of the weight, a motor and a powder clutch, or the like. In a state where the wire material W is wrapped alternately on the plurality of fixed-side pulleys 30 and on the plurality of movable-side pulleys 40, if the distance between the axes of the fixed axis part 32 and the movable axis part 42 is increased due to the force applied by the wire-accumulating-force application mechanism part 60, a larger length dimension of the wire material W is accumulated between the plurality of fixed-side pulleys 30 and the plurality of movable-side pulleys 40. If the distance between the axes of the fixed axis part 32 and the movable axis part 42 is reduced due to, for example, acceleration of an external drawing speed of the wire material W, the wire material W accumulated between the plurality of fixed-side pulleys 30 and the plurality of movable-side pulleys 40 is fed to the outside. Here, a powder clutch or the like may be adopted as the bearings of the fixed-side pulleys 30 and the movable-side pulleys 40 such that a tensile force applied to the wire material W can be adjusted.

The drawing mechanism part 50 is configured to apply a drawing force to the wire material W in the middle of wrapping of the wire material W from any one to another of the plurality of fixed-side pulleys 30 and the plurality of movable-side pulleys 40.

Here, the drawing mechanism part 50 includes a drawing pulley 52 and a rotary drive part 54.

The drawing pulley 52 is disk-shaped, and has an annular groove formed on an outer circumference thereof so that the wire material W can be wrapped therealong. The drawing pulley 52 is supported by the rotary drive part 54 at a position opposite to the movable-side pulleys 40 across the fixed-side pulleys 30 so as to be rotatable on a rotation axis 52X that is parallel to rotation axes of the fixed-side pulleys 30 and the movable-side pulleys 40. In other words, the movable-side pulleys 40, the fixed-side pulleys 30, and the drawing pulley 52 are aligned in a straight line with the rotation axes thereof all extending in the same direction, and the fixed-side pulleys 30 are provided between the movable-side pulleys 40 and the drawing pulley 52. The wire material W is wrapped on the drawing pulley 52 instead of being wrapped on the fixed-side pulleys 30.

Here, the position of the drawing pulley 52 may be shifted in a direction (for example, the vertical direction) perpendicular to the direction of movement of the movable-side pulleys 40 (that is, the direction connecting the movable-side pulleys 40 and the fixed-side pulleys 30), as long as the shift is to such a degree that the movable-side pulleys 40, the fixed-side pulleys 30, and the drawing pulley 52 overlap when seen along the direction of movement of the movable-side pulleys 40. This arrangement also applies to the arrangement in which the drawing pulley 52 is provided at the side opposite to the movable-side pulleys 40 across the fixed-side pulleys 30. In an example which will be described here, the position of the drawing pulley 52 is shifted.

With respect to the direction of the rotation axis 52X, the position of the drawing pulley 52 is identical to the position of the central one of the plurality of fixed-side pulleys 30. For example, in a case where there are thirteen fixed-side pulleys 30 and fourteen movable-side pulleys 40, it is preferable to provide the drawing pulley 52 at a position identical to the position of the seventh fixed-side pulley 30 from the side of entry of the wire material W. In this case, for example, the wire material W is wrapped around the seventh movable-side pulley 40 and then, instead of being wrapped around the seventh fixed-side pulley 30, wrapped around the drawing pulley 52, and then wrapped around the eighth movable-side pulley 40. In a case where the number of fixed-side pulleys 30 is an even number, it is preferable that the drawing pulley 52 is arranged in a position identical to either one of the central two fixed-side pulleys 30 with respect to the direction of the rotation axis 52X.

The diameter of the drawing pulley 52 is set to be larger than the diameter of the fixed-side pulley 30. Moreover, the rotation axis 52X of the drawing pulley 52 is arranged in a position shifted (for example, a position shifted in a vertical direction) from a line connecting the rotation axis 42X of the movable-side pulleys 40 and the rotation axis 32X of the fixed-side pulleys 30. One extension portion (here, a portion extending out from the lower side; see FIG. 3) of the wire material W wrapped around the drawing pulley 52 is guided by the corresponding middle fixed-side pulley 30 and wrapped around the movable-side pulley 40, while the other extension portion (here, a portion extending out from the upper side; see FIG. 3) of the wire material W wrapped around the drawing pulley 52 passes over the corresponding fixed-side pulley 30 without a contact therewith and is wrapped around the movable-side pulley 40. As a result, at the upper side of the fixed-side pulley 30, a contact between the fixed-side pulley 30 and the wire material W is avoided, while at the lower side of the fixed-side pulley 30, the wire material W is pressed to the outer circumferential groove of the fixed-side pulley 30 to thereby avoid an unstable contact between the wire material W and the outer circumferential groove wall.

It is not essential that, as described above, the diameter of the drawing pulley 52 is larger than the diameter of the fixed-side pulley and that the rotation axis 52X of the drawing pulley 52 is arranged in a shifted position. The diameter of the drawing pulley 52 may be equal to or smaller than the diameter of the fixed-side pulley, or the rotation axis 52X of the drawing pulley 52 may be aligned with the line connecting the rotation axis 32X of the fixed axis part 32 and the rotation axis 42X of the movable axis part 42. Moreover, for example, the diameter of the drawing pulley 52 may be larger than the diameter of the fixed-side pulley, and the rotation axis 52X of the drawing pulley 52 may be aligned with the line connecting the rotation axis 32X of the fixed axis part 32 and the rotation axis 42X of the movable axis part 42. In this case as well, both extension portions of the wire material W wrapped around the drawing pulley 52 can be prevented from coming into contact with the fixed-side pulley 30, as long as the diameter of the drawing pulley 52 is larger than the diameter of the fixed-side pulley. For example, the diameter of the drawing pulley 52 may be equal to or smaller than the diameter of the fixed-side pulley, and the rotation axis 52X of the drawing pulley 52 may be shifted from the line connecting the rotation axis 32X of the fixed axis part 32 and the rotation axis 42X of the movable axis part 42. In this case as well, shifting the rotation axis 52X of the drawing pulley 52 can prevent the shifted-side one of both extension portions of the wire material W wrapped around the drawing pulley 52 from coming into contact with the fixed-side pulley 30.

The rotary drive part 54 is configured to drive the drawing pulley 52 in rotation. Here, the rotary drive part 54 includes a motor 56, and a driving axis part 56a of the motor 56 is directly coupled to the center of the drawing pulley 52. It is preferable that a motor capable of a constant torque control, such as a servomotor, is adopted as the motor 56. Here, the description will be given of an example in which the motor 56 capable of the torque constant control is used.

Although in this embodiment, the driving axis part 56a of the motor 56 is directly coupled to the drawing pulley 52, this is not essential. The rotary motion of the motor 56 may be transmitted to the drawing pulley 52 by means of a transmission mechanism such as a gear, a ring belt, or a combination of them.

An operation of the rotary drive part 54 is controlled by a control unit 58. The control unit 58 is an ordinary microcomputer including a CPU, a ROM, a RAM, and the like, and controls the driving of the motor 56 in accordance with software program stored in advance and a predetermined set value. Here, the control unit 58 performs the torque constant control on the motor 56 so as to keep the drawing force acting on the wire material W constant. This enables the drawing mechanism part 50 to apply as constant a drawing force as possible to the wire material W irrespective of the magnitude of the external drawing speed or the like. A target drawing force (target torque) is preferably set within a range not causing break or excessive stretch of the wire material W. Additionally, the target drawing force (target torque) is preferably set such that a feeding speed of the wire material W in the drawing mechanism part 50 cannot be largely different from the external drawing speed as a result of the torque constant control which may otherwise loosen the wire material W at the fixed-side pulleys 30 or the movable-side pulleys 40. Actually, the target drawing force (target torque) can be obtained from a theoretical, experimental, and empirical consideration in accordance with the type of the wire material W, the number of the fixed-side pulleys 30, the number of the movable-side pulleys 40, an assumed value of the external drawing speed, and the like.

To the control unit 58, a signal corresponding to a downstream-side (the extrusion coating device side or the winding apparatus side) external drawing speed is inputted, and a signal corresponding to a rotational speed caused by the motor 56 is inputted. The control unit 58 determines whether or not the drawing speed of the wire material W in accordance with the rotational speed of the motor 56 is within an acceptable range based on the external drawing speed (for example, within a range of the external drawing speed $\pm\alpha$, or the external drawing speed $\pm\alpha\%$), and if the drawing speed of the wire material W is not within the acceptable range based on the external drawing speed, outputs an alarm signal or a stop signal. This allows an operator to stop the feed of the wire material W and check this apparatus and related apparatuses, manufacturing conditions, and the like.

The motor 56 may control the speed so as to feed out the wire material W at a speed in accordance with the external drawing speed, or may not perform such a control. It suffices that a drawing force can be applied to the wire material W by means of the drawing mechanism part 50.

The wire material W is wrapped around the wire material accumulator 20 as follows. The wire material W unwound from the upstream side (the wire material supply part or the extrusion coating device) is alternately wrapped around the plurality of fixed-side pulleys 30 and the plurality of movable-side pulleys 40 in a direction from one side to the other side of the arrangement of the plurality of movable-side pulleys 40 and in a direction from one side to the other side of the arrangement of the plurality of fixed-side pulleys 30. In the middle of the wrapping, the wire material W is wrapped around the seventh movable-side pulley 40 and then, instead of being wrapped around the seventh fixed-side pulley 30, wrapped around the drawing pulley 52, and then wrapped around the eighth movable-side pulley 40. At this time, the wire material W passes through a lower part of the groove of the seventh fixed-side pulley 30. The wire material W is wrapped around the movable-side pulley 40 or the fixed-side pulley 30 at the other side of the arrangement direction, and then introduced to the extrusion coating device, the winding part, or the like.

During the feed of the wire material W, the wire material accumulator 20 operates as follows. Firstly, it is assumed that, in a state where the movable-side pulleys 40 are positioned apart from the fixed-side pulleys 30 with the wire material W being accumulated therebetween, the wire material W is drawn to the outside. In this state as well, the drawing mechanism part 50 applies a drawing force to the wire material W between the plurality of fixed-side pulleys 30 and the plurality of movable-side pulleys 40. When the external drawing speed is accelerated in this state, the movable axis part 42 is moved toward the fixed axis part 32, so that the accumulated wire material W is unwound while the rotational speed of the fixed-side pulleys 30 and the movable-side pulleys 40 is increased. As a result, for example, due to inertial forces of the fixed-side pulleys 30 and the movable-side pulleys 40, a resistance force (for example, approximately 1.11N) is applied to the wire material W at portions of the wire material W wrapped around the fixed-side pulleys 30 and the movable-side pulleys 40.

Here, assuming that the drawing mechanism part 50 is not provided, if the wire material W unwound from the accumulator 20 is drawn by a force F1 (for example, 35N), a total resistance force Fr (for example, in a case where a resistance force per unit is 1.11N and there are thirteen fixed-side pulleys 30 and fourteen movable-side pulleys 40, approximately $1.11N\times(13+14)=30N$) of the fixed-side pulleys 30 and the movable-side pulleys 40 is applied. Consequently, a force F2 applied to the wire material W introduced to the accumulator 20 is F1−Fr (for example, approximately 5N). Thus, there is a large difference between the side at which the wire material W enters the accumulator 20 (hereinafter referred to as wire entrance side) and the side at which the wire material W exits the accumulator 20 (hereinafter referred to as wire exit side).

As a result, the wire material W may be loosened at the wire entrance side, while the wire material W may be stretched due to excessive drawing of the wire material W at the wire exit side.

On the other hand, in a case where the drawing mechanism part 50 is provided, if the wire material W unwound from the accumulator 20 is drawn by the force F1 (for example, 25N), it can be considered that a force of about half the above-mentioned total resistance force Fr is applied between the wire exit side and the drawing mechanism part 50. Therefore, a force M1=F1−Fr/2 (for example approximately 11N) is applied to the wire material W exiting the drawing mechanism part 50. If the drawing force of the drawing mechanism part 50 is set to M2 (for example, 25N), the force M2 is applied to the wire material W being introduced to the drawing mechanism part 50. Additionally, it can be considered that a force of about half the above-mentioned total resistance force Fr is applied between the drawing mechanism part 50 and the wire entrance side for entry into the accumulator 20. Accordingly, the force F2=M2−Fr/2 (for example, approximately 11N) is applied to the wire material W at the wire entrance side. Thus, in the accumulator 20, a drawing force applied to the wire material W is at most the force F1, M2 (for example, approximately 25N) and at least the force F2, M1 (for example, approximately 11N).

The wire material accumulator 20 configured as described above includes the drawing mechanism part 50 that applies a drawing force to the wire material W in the middle of the wire material W being wrapped from any one to another of the plurality of fixed-side pulleys 30 and the plurality of movable-side pulleys 40. Therefore, in a case of, for example, accelerating the external drawing speed, an influence of a resistance force applied to the wire material W can be suppressed, and a tensile force applied to the wire material W at a portion of the wire material W being unwound from the accumulator 20 can be suppressed. This can reduce the tensile force applied to the wire material W at the unwound side, and furthermore can suppress stretch of the wire material W. Since the drawing force caused by the drawing mechanism part 50 is transmitted to the wire entrance side of the wire material W while receiving a smaller resistance force, the tensile force applied to the wire material W at the wire entrance side can be relatively increased. As a result, the wire material W can be kept steadily wrapped around the fixed-side pulleys 30 and the movable-side pulleys 40, so that derailing, or the like, of the wire material W can be suppressed. As a result, in the accumulator 20, a difference in the force applied to the wire material W can be reduced and stabilized, which enables a stable supply of the wire material W.

Additionally, a difference in the tensile force between the wire entrance side and the wire exit side can be reduced, and consequently a restriction on the amount of wire accumulation, which results from the difference in the tensile force, can be suppressed. Thereby, the number of the fixed-side pulleys 30 and the movable-side pulleys 40 can be increased, so that a wire accumulation capacity can be increased. Moreover, the accumulator 20 allows an increase in the number of the fixed-side pulleys 30 and the movable-side pulleys 40 to thereby increase the wire accumulation capacity, and consequently a distance of movement of the movable axis part 42 can be shortened to reduce the length of a feed line of the wire material W. Furthermore, since the difference in the force applied to the wire material W can be reduced, even if the external drawing speed is rapidly accelerated or decelerated, a problem that, for example, the wire material W is stretched hardly occurs. Therefore, such rapid acceleration or deceleration is allowed.

Besides, the accumulator 20 can be implemented by adding the drawing mechanism part 50 to the accumulator 20 including the plurality of fixed-side pulleys 30 and the plurality of movable-side pulleys 40. Thus, the configuration thereof is simple, and an operation for setting the wire material W is relatively easy.

The drawing mechanism part 50 includes the drawing pulley 52 and the rotary drive part 54, and therefore can be implemented with a relatively simple configuration. By wrapping the wire material W around the drawing pulley 52 in the middle of the wrapping, the drawing force can be easily applied to the wire material W.

Since the drawing pulley 52 is provided at the side opposite to the movable-side pulleys 40 across the fixed-side pulley 30, the accumulator 20 can be housed and installed in an elongated space.

Here, in a case where the drawing pulley 52 is provided outside the movable-side pulleys 40, it is necessary to provide the drawing pulley 52 at the outer side of the position where the movable-side pulleys 40 are most distant from the fixed-side pulleys 30. In this case, a need arises for wrapping the wire material W across a long distance between the fixed-side pulleys 30 and the drawing pulley 52. This makes the operation for setting the wire material W difficult. Moreover, since the wire material W is always stretched across the long distance, the wire material W is likely to be damaged due to a contact with a peripheral member. On the other hand, in a case where the drawing pulley 52 is provided at the side opposite to the movable-side pulleys 40 across the fixed-side pulleys 30, the distance between the drawing pulley 52 and the movable-side pulleys 40 can be reduced as compared with the above case. Therefore, the operation for setting the wire material W is easier and the damage to the wire material W is suppressed, as compared with the above case.

The diameter of the drawing pulley 52 is larger than the diameter of the fixed-side pulleys 30. This allows at least one of both extension portions of the wire material W wrapped around the drawing pulley 52 to avoid a contact with the fixed-side pulley 30. As a result, damage to the wire material W due to an unstable contact between the wire material W and the fixed-side pulley 30 can be suppressed.

The rotation axis 52X of the drawing pulley 52 is shifted from the line connecting the rotation axis 32X of the fixed axis part 32 and the rotation axis 42X of the movable axis part 42, so that one extension portion (here, the portion extending out from the lower side; see FIG. 3) of the wire material W wrapped around the drawing pulley 52 is guided by the corresponding middle fixed-side pulley 30 and wrapped around the movable-side pulley 40, while the other extension portion (here, the portion extending out from the upper side; see FIG. 3) of the wire material W wrapped around the drawing pulley 52 passes over the corresponding fixed-side pulley 30 without a contact therewith and is wrapped around the movable-side pulley 40. As a result, at the upper side of the fixed-side pulley 30, an unstable contact between the fixed-side pulley 30 and the wire material W is avoided to suppress damage to the wire material W, while at the lower side of the fixed-side pulley 30, the wire material W is pressed to the outer circumferential groove of the fixed-side pulley 30 to thereby avoid an unstable contact between the wire material W and the outer circumferential groove wall to suppress damage to the wire material W at this portion, too.

{Modification}

A modification of the wire material accumulator 20 will be described.

Firstly, two or more drawing mechanism parts 50 may be provided. Thereby, a drawing force can be applied to a plurality of portions in the middle of traveling of the wire material W in the accumulator 20, so that a difference in a pulling force applied to the wire material W can be further reduced, which allows an enhanced stabilization of the tensile force applied to the wire material W. Such a configuration having a plurality of drawing mechanism parts 50 is advantageous when an increased number of the fixed-side pulleys 30 and the movable-side pulleys 40 are provided.

Figure 4:
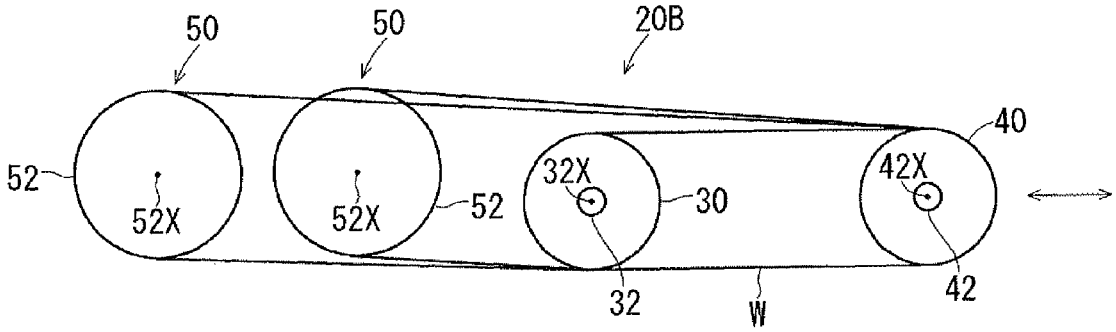
FIG. 4 is a schematic side view showing a wire material accumulator according to a modification.
Figure 5:
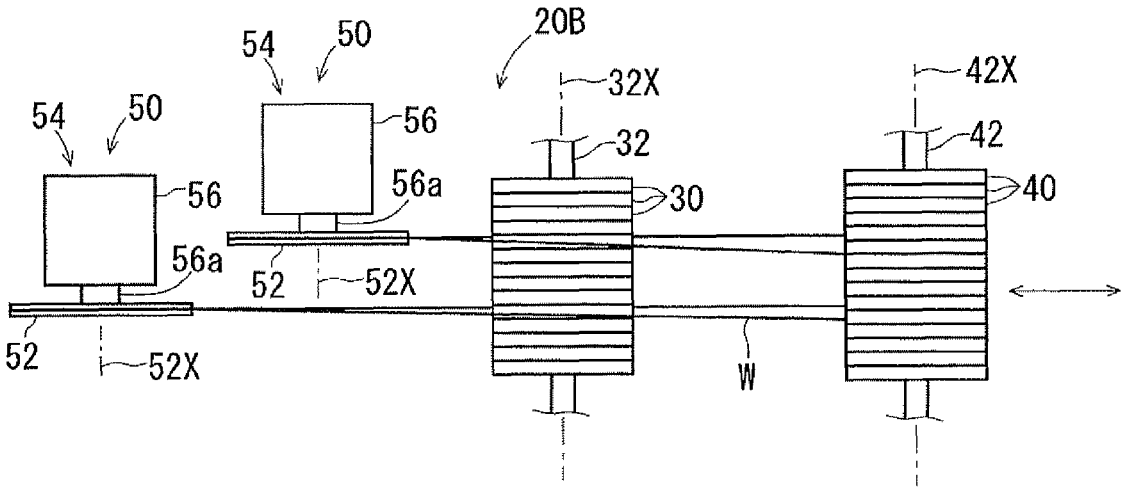
FIG. 5 is a schematic top view showing the wire material accumulator according to the modification.

In a case of providing a plurality of drawing mechanism parts 50, it is necessary to avoid interference of the motor 56 or the like. For this purpose, as shown in FIGS. 4 and 5, the plurality of drawing mechanism parts 50 may be provided so as to be shifted along the direction of movement of the movable axis part 42 (that is, the direction connecting the fixed axis part 32 and the movable axis part 42). Thereby, an accumulator 20B can be installed in a relatively elongated space.

Figure 6:
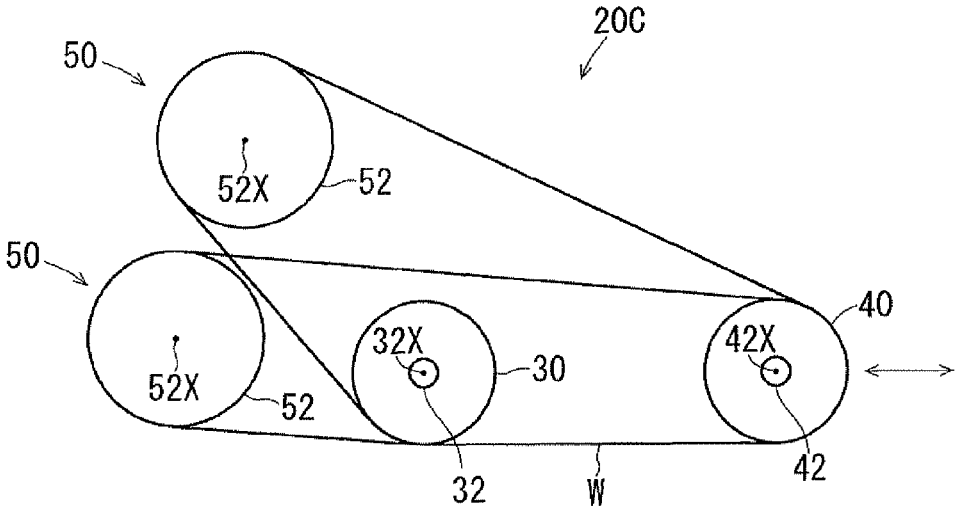
FIG. 6 is a schematic side view showing a wire material accumulator according to another modification.

Alternatively, as an accumulator 20C shown in FIG. 6, a plurality of drawing mechanism parts 50 may be provided so as to be shifted in a direction (here, shifted in the vertical direction) crossing both of the fixed axis part 32 and the direction of movement of the movable axis part 42. In this configuration, too, the plurality of drawing mechanism parts 50 can be provided while suppressing interference among the plurality of drawing mechanism parts 50.

In a case of providing a plurality of drawing mechanism parts 50, it is preferable to, depending on the number of the drawing mechanism parts 50 to be installed, provide the drawing mechanism part 50 at a position corresponding to a boundary that equally divides the plurality of fixed-side pulleys 30.

The configuration of the drawing mechanism part 50 is not limited to the above-described example. In a possible exemplary configuration, a wire material is interposed between a plurality of rollers, and the rollers are driven in rotation by a motor to thereby apply a drawing force to the wire material. That is, it suffices that the drawing mechanism part 50 is configured to apply a drawing force to a wire material that is continuously fed.

The position where the drawing mechanism part 50 is arranged is not limited to the above-described one. For example, the drawing mechanism part 50 may be arranged above or below the fixed-side pulleys 30, or at the side opposite to the fixed-side pulleys 30 across the movable-side pulleys 40.

Moreover, the position of the drawing pulley 52 in the rotation axis 52X is not limited to the above-described one. It suffices that the drawing pulley 52 is provided at an outside position corresponding to either one of the plurality of fixed-side pulleys 30 and the plurality of movable-side pulleys 40. In other words, it suffices that the drawing pulley 52 is provided at such a position that the wire material W can be wrapped around the drawing pulley 52 in the middle of being wrapped from any one to another of the plurality of fixed-side pulleys 30 and the plurality of movable-side pulleys 40.

Figure 7:
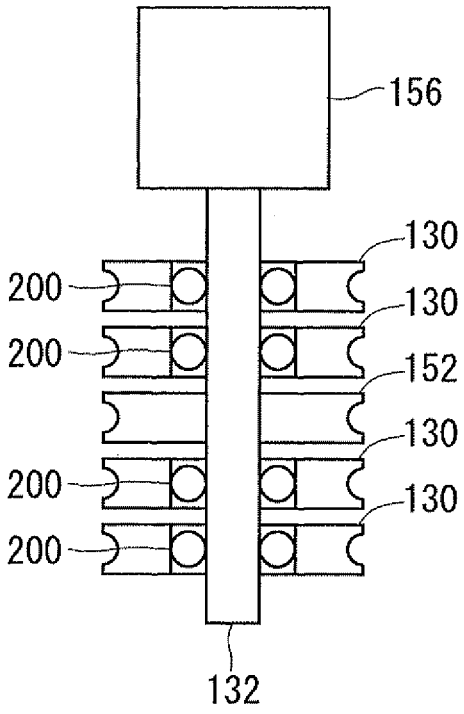
FIG. 7 is a schematic view showing a drawing mechanism part according to a modification.

As shown in FIG. 7, it may also be acceptable that a fixed axis part 132 that rotatably supports a plurality of fixed-side pulleys 130 via bearings 200 are driven in rotation by a drawing rotary drive part 156 including a motor, and additionally a drawing pulley 152 is fixed to the fixed axis part 132. It is preferable that the drawing pulley 152 is provided between any ones of the plurality of fixed-side pulleys 130. Preferably, while making the plurality of fixed-side pulleys 130 rotatable along with traveling of the wire material, the drawing rotary drive part 156 is driven to rotate the drawing pulley 152, to thereby draw the wire material. It is preferable that the motor is driven with an arbitrary torque by a torque constant control. In this case, the drawing rotary drive part 156, the fixed axis part 132, and the drawing pulley 152 form a drawing mechanism part.

The above-described configuration may be incorporated in movable-side pulleys, or in both of fixed-side pulleys and movable-side pulleys.

The configurations described in the embodiments and modifications above may be appropriately combined as long as they are not mutually inconsistent.

The invention claimed is:

1. A wire material accumulator configured to accumulate a wire material, said wire material accumulator comprising:

a plurality of fixed-side pulleys rotatably supported on a fixed axis part;

a plurality of movable-side pulleys rotatably supported on a movable axis part that is supported so as to be movable toward and away from said fixed axis part; and a drawing mechanism part that applies a drawing force to a wire material in the middle of said wire material being wrapped from any one to another of said plurality of fixed-side pulleys and said plurality of movable-side pulleys.

2. The wire material accumulator according to claim 1, wherein said drawing mechanism part includes a drawing pulley around which said wire material can be wrapped and a rotary drive part that drives said drawing pulley in rotation, said drawing pulley being arranged in such a position that the wire material can be wrapped around said drawing pulley in the middle of being wrapped from any one to another of said plurality of fixed-side pulleys and said plurality of movable-side pulleys.

3. The wire material accumulator according to claim 2, wherein said drawing pulley is provided at the side opposite to said movable-side pulleys across said fixed-side pulleys.

4. The wire material accumulator according to claim 3, wherein the diameter of said drawing pulley is larger than the diameter of said fixed-side pulley.

5. The wire material accumulator according to claim 2, wherein said drawing pulley is provided in such a position that one extension portion of the wire material wrapped around said drawing pulley can be guided by any of said plurality of fixed-side pulleys and wrapped around any of said plurality of movable-side pulleys while the other extension portion of the wire material wrapped around said drawing pulley can be wrapped around any of said plurality of movable-side pulleys without a contact with said plurality of fixed-side pulleys.

6. The wire material accumulator according to claim 1, wherein said drawing mechanism part comprises a plurality of drawing mechanism parts.

7. The wire material accumulator according to claim 6, wherein said plurality of drawing mechanism parts are provided so as to be shifted from one another in a direction of movement of said movable axis part.

8. The wire material accumulator according to claim 6, wherein said plurality of drawing mechanism parts are provided so as to be shifted from one another in a direction crossing both an axis of said fixed axis part and a direction of movement of said movable axis part.

* * * * *